US006149201A

United States Patent [19]

Cole et al.

[11] Patent Number: 6,149,201

[45] **Date of Patent: *Nov. 21, 2000**

[54] SPHERICAL TOY BALL ANIMATION TOY

[75] Inventors: Jeffrey Charles Cole; Kenneth H. Fleck, both of Denver, Colo.

[73] Assignee: According Publishing LTD, Denver, Colo.

[ * ] Notice: This patent is subject to a terminal disclaimer.

[21] Appl. No.: 09/373,162

[22] Filed: Aug. 12, 1999

Related U.S. Application Data

[63] Continuation of application No. 08/902,452, Jul. 29, 1997, Pat. No. 5,941,570.

[60] Provisional application No. 60/026,447, Sep. 18, 1996.

[51] Int. Cl.[7] ..... B42D 1/00; B44F 1/10

[52] U.S. Cl. ..... 281/51; 281/38; 283/117

[58] Field of Search ..... 281/38, 51; 283/117

[56] References Cited

U.S. PATENT DOCUMENTS

| | | | |
|---|---|---|---|
| 1,028,921 | 6/1912 | Wagner . | |
| 1,033,576 | 7/1912 | Garman . | |
| 2,489,240 | 11/1949 | Meyer | 46/34 |
| 2,538,085 | 1/1951 | Cotton | 35/8 |
| 3,918,180 | 11/1975 | Chamberlin . | |
| 5,915,729 | 6/1999 | Vap . | |
| 5,941,570 | 8/1999 | Cole et al. | 281/38 |

OTHER PUBLICATIONS

Title: Eye Spy a Panda! Author: Jean Hwang 1995 Publisher: Threehouse Children's Books Limited.

*Primary Examiner*—Willmon Fridie, Jr.
*Assistant Examiner*—Mark T. Henderson
*Attorney, Agent, or Firm*—Rick Martin; Patent Law Offices of Rick Martin, P.C.

[57] ABSTRACT

The present invention is a toy for amusement. The toy is comprised of a cardboard-like panel with one or more spherical toy balls, commonly known as "floating eyeballs," Jet Balls™ or Glide Balls™, affixed to the panel which bears graphic depictions including human, insect, animal, or creature-like facial features on both its front and back surfaces. The panel can be hingedly connected to a book or other card-like device such that when the panel is turned over or opened, a new panel bearing different features appears. The panel and spherical toy ball(s) together make an entertaining three-dimensional representation that can be controlled by the user to create a visual effect in which the spherical toy ball(s) move about in a manner similar to human-like eye movement. Another embodiment shows a daytime calendar having the spherical toy balls protruding through the top page of the calendar.

7 Claims, 11 Drawing Sheets

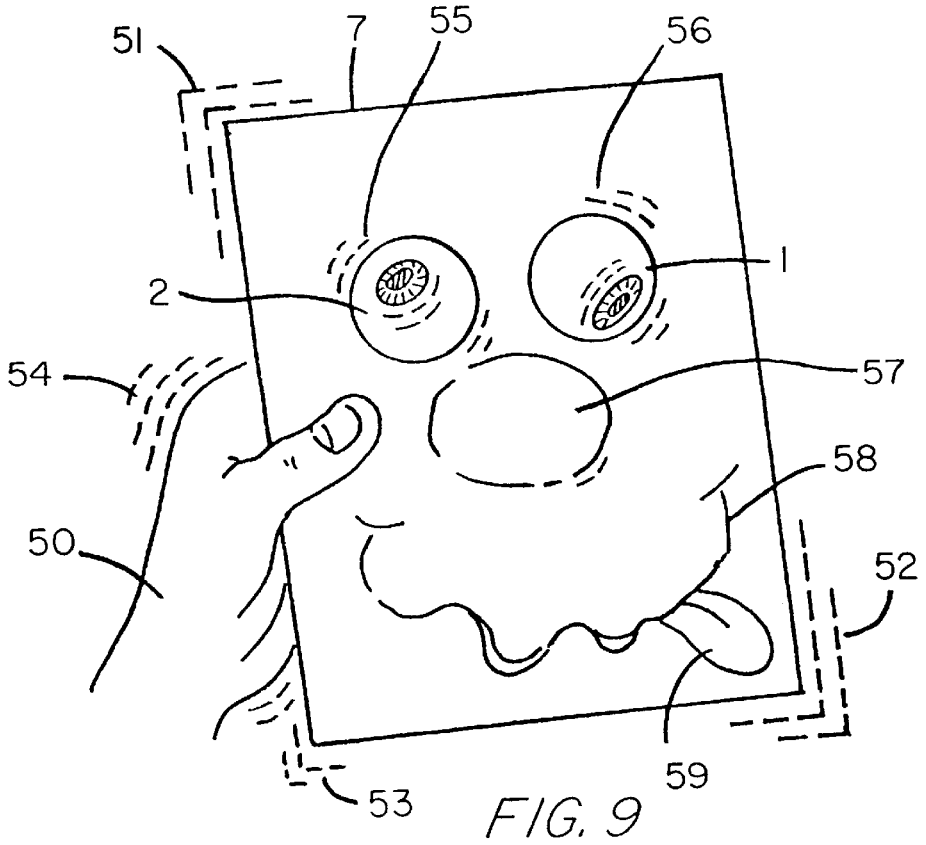
FIG. 9
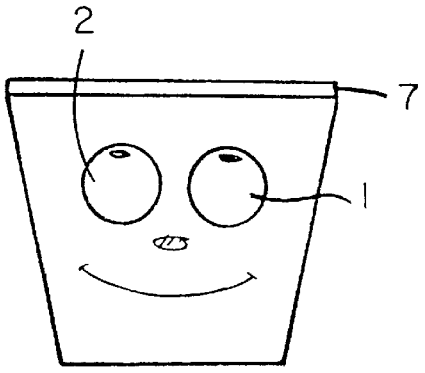
FIG. 10a
FIG. 10b
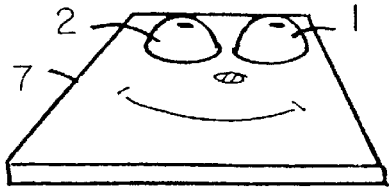
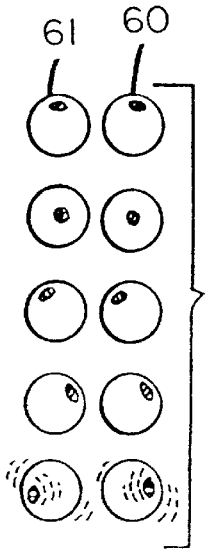
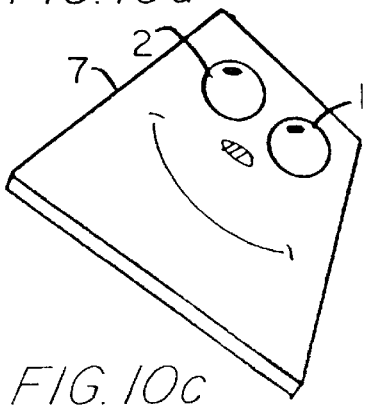
FIG. 10c
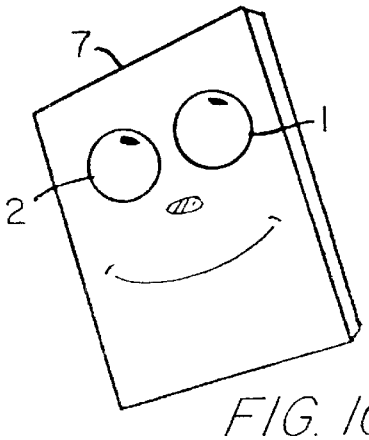
FIG. 10d
FIG. 10e

SPHERICAL TOY BALL ANIMATION TOY

CROSS-REFERENCE TO RELATED APPLICATION

This application is a continuing application claiming the benefits of U.S. Pat. Ser. No. 08/902,452 filed Jul. 29, 1997 and issued as U.S. Pat. No. 5,941,570 on Aug. 24, 1999, which claimed the benefits of provisional application Ser. No. 60/026,447 filed Sep. 18, 1996.

FIELD OF THE INVENTION

The present invention relates to using known spherical toy balls, commonly known as "floating eyeballs," Jet Balls™ or Glide Balls™ in a panel or panels to create an amusing and entertaining three-dimensional display.

BACKGROUND OF INVENTION

Known in the art are "floating eyeballs" comprised of an eyeball-decorated (i.e. pupil, iris, blood vessels, etc.) inner sphere encased and floating within a larger clear outer sphere. The inner and outer spheres are separated by a clear liquid. The eyeball-decorated inner sphere is weighted such that the pupil automatically rotates upwards no matter which direction the sphere is rotated. It is not known to combine the floating eyeball with a plurality of hingedly connected panels, thereby forming a plurality of three-dimensional animations. The present invention creates a toy that in one embodiment creates a plurality of facial expressions by combining said panels and one or more pair of floating eyeballs. It is known in the art that any floating objects including belly buttons, other body parts, and/or graphic designs would all be equivalent to the best mode depiction herein of floating eyeballs.

SUMMARY OF THE INVENTION

The present invention is a toy for amusement. The toy is comprised of a panel with one or more spherical toy balls, commonly known as the above noted "floating eyeballs." The panel can bear features resembling a human, insect, animal or other creature-like facial expression. The panel can bear facial features on both its front and back surfaces. The panel can be hingedly connected to a book or other card-like object such that when the connected panel is flipped over or turned open, a new panel bearing different artwork or facial features appears. The panel and floating eyeballs together make an entertaining three-dimensional character representation that can be controlled by the user to create an animated effect called "eyeball animation™." "Eyeball animation™" describes a visual effect in which the eyeball-decorated inner sphere moves about the clear plastic outer sphere in a manner similar to human-like eye movement.

The primary aspect of the present invention is to affix a floating eyeball to a panel so as to create a variety of entertaining and amusing facial expressions and scenes via the combination.

Another aspect of the present invention is to allow the user to create additional entertaining and amusing scenes by shaking or tilting the panel causing the floating eyeballs to move in different directions thereby providing the artwork surrounding the "floating eyeballs" varied visual affects.

Another aspect of the present invention provides the user a variety of entertaining and amusing facial expressions or scenes quickly and conveniently. The present invention attaches the primary panel to the front cover of a book, card, or other surface with the inner pages being additional panels bearing different facial expressions or scenes. Since the floating eyeballs automatically rotate upwards, the user has quick and convenient access to additional facial expressions and scenes by either turning the panel over to its other side or opening the front cover and turning the inner pages and back cover of the book or card.

Another aspect of the present invention is to permit the user to create his own entertaining three dimensional representations by introducing blank panels over and around the floating eyeballs affixed to the primary panel such that the user may draw, paint or otherwise place an image of his own creation on the blank panel.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 9 is a top plan view showing the user shaking the panel to create a visual display of dancing eyeballs.

FIGS. 10a, 10b, 10c, 10d, 10e are various top perspective views showing the floating eyeballs automatically rotating upwards when panels are tilted at different angles or directions.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
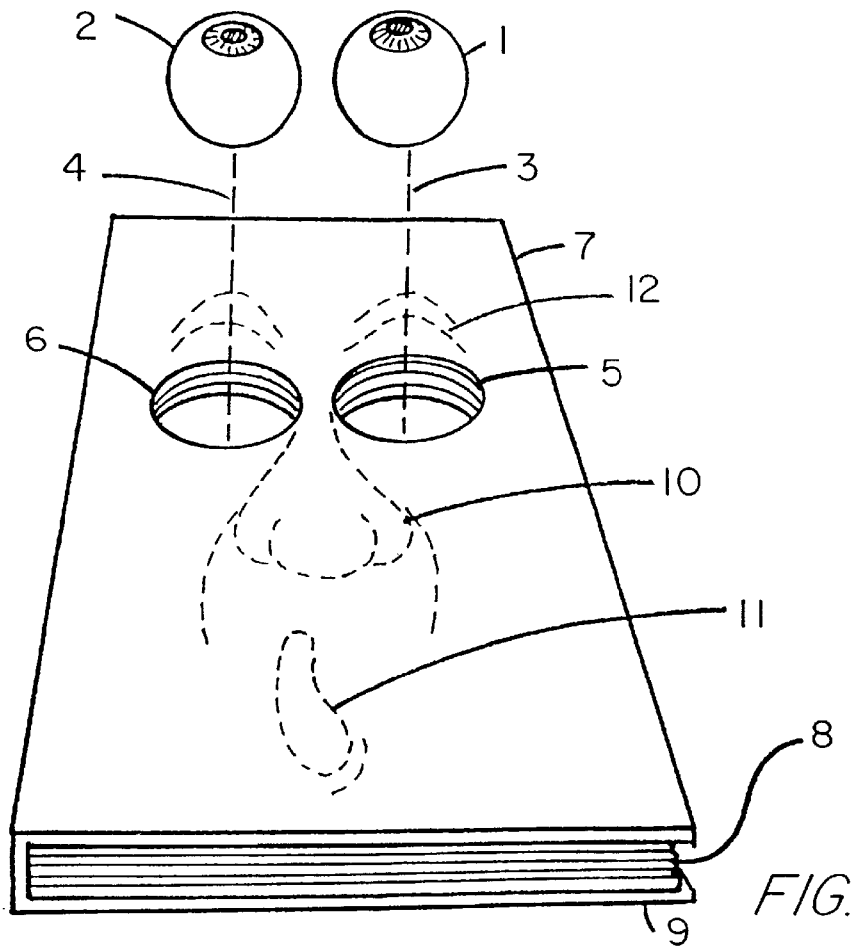
FIG. 1 is a top perspective view of the front panel, said panel being a book, card cover, or two-surfaced (front and back) panel showing the eyeholes and the placement of the floating eyeballs in the panel.
Figure 2:
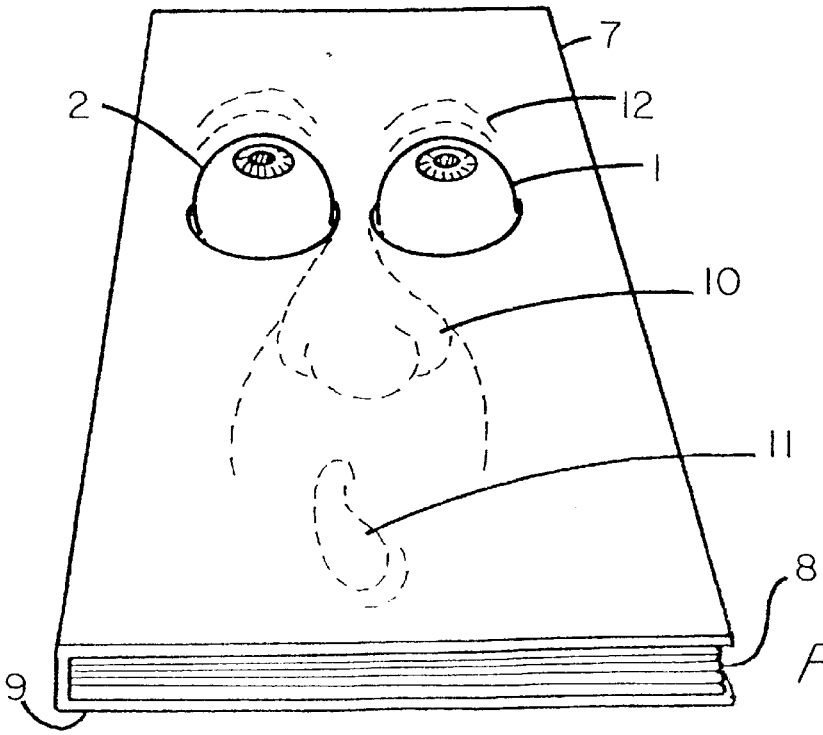
FIG. 2 is a top perspective of the front panel, said panel being a book or card cover, i.e., two-surfaced (front and back) panel showing the floating eyeballs embedded in the panel.

FIGS. 1, 2 are top perspective views of the invention and show the embedding of the floating eyeballs 1, 2 into the panel 7. The panel 7 can be made of varied materials including cardboard, plastic and the like. Each floating eyeball 1, 2 is mounted onto the panel 7 either directly to the panel surface or preferably embedded into the eye holes 5, 6. See the dotted lines 3 and 4 between the eyeballs and the eye holes in the panel. Approximately one-half of the floating eyeballs bulge outwardly from both the front and back sides of the panel. See top and side profile views in FIGS. 7, 8. This can be accomplished by 9 cutting or punching out circular holes 5 and 6 the size of each eyeball 1 and 2 from the panel 7 and then inserting and affixing the eyeballs 1 and 2 to the panel 7 by any number of methods including a permanent lock or glue system. See FIG. 2 for a perspective front and bottom view of the floating eyeballs embedded into the panel. Also, included in FIG. 1, 2 are depictions of inner pages 8 , back cover 9 and facial features 10.

Figure 6:
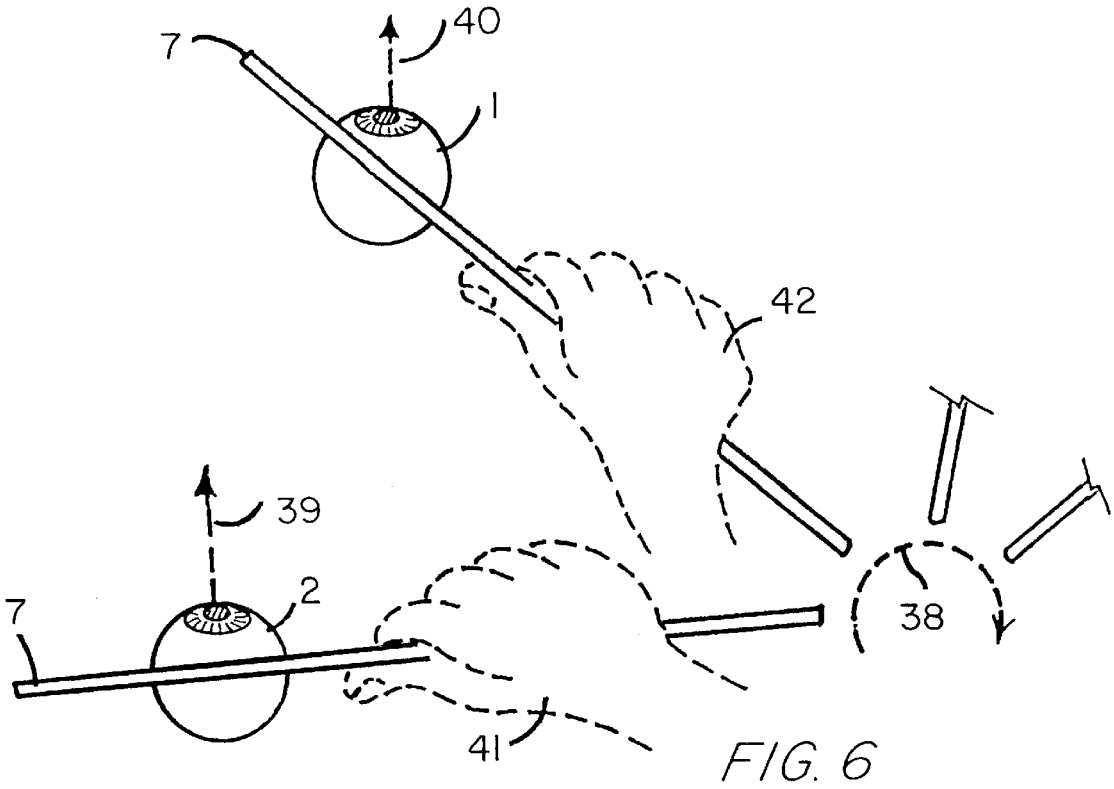
FIG. 6 is a side profile view of the panel being tilted by the user in order to show the floating eyeball's automatic rotation upwards no matter what angle or direction the panel is tilted.
Figure 7:
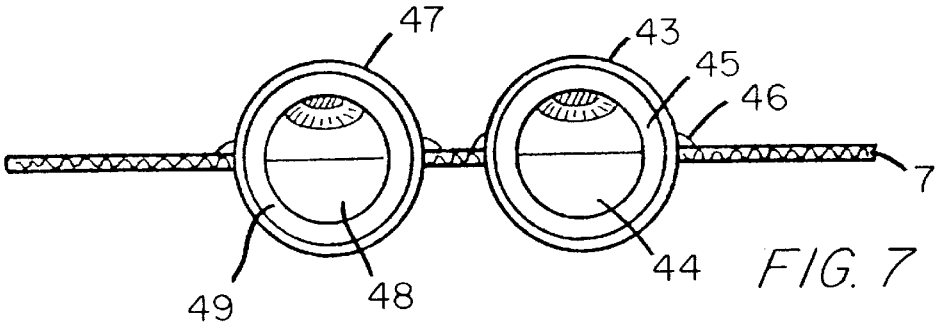
FIG. 7 is a top profile view of the panel showing the floating eyeballs bulging out of both the front and back of the panel.
Figure 8:
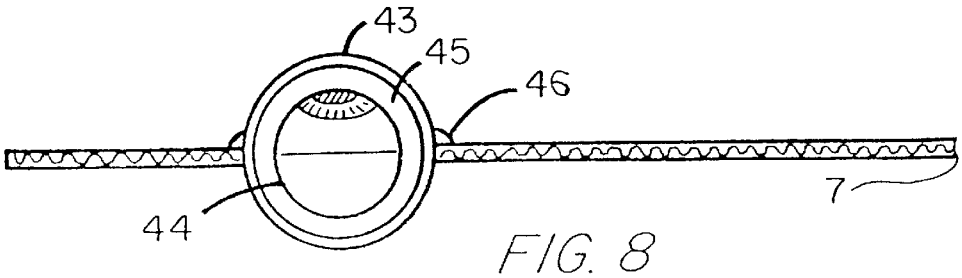
FIG. 8 is a side profile view of the panel showing the floating eyeball bulging out of both the front and back of the panel.

FIGS. 7, 8 show the floating eyeballs comprised of an eyeball-decorated inner sphere 44, 48 encased and floating in a clear plastic outer sphere 43, 47 filled with a clear liquid 44, 48. The eyeball-decorated inner sphere 44 is weighted such that the pupil automatically rotates upwards no matter which direction the outer sphere 43 is rotated. The outer sphere 43 is affixed to the panel 7 by any number of methods including a permanent lock or glue system 46. FIG. 6 depicts the upwards rotation of the floating eyeball 1 when the outer sphere, as affixed to the panel 7, is tilted away from horizontal. The floating eyeball 1 in this example, is an existing toy that is available in the current retail marketplace.

Figure 3:
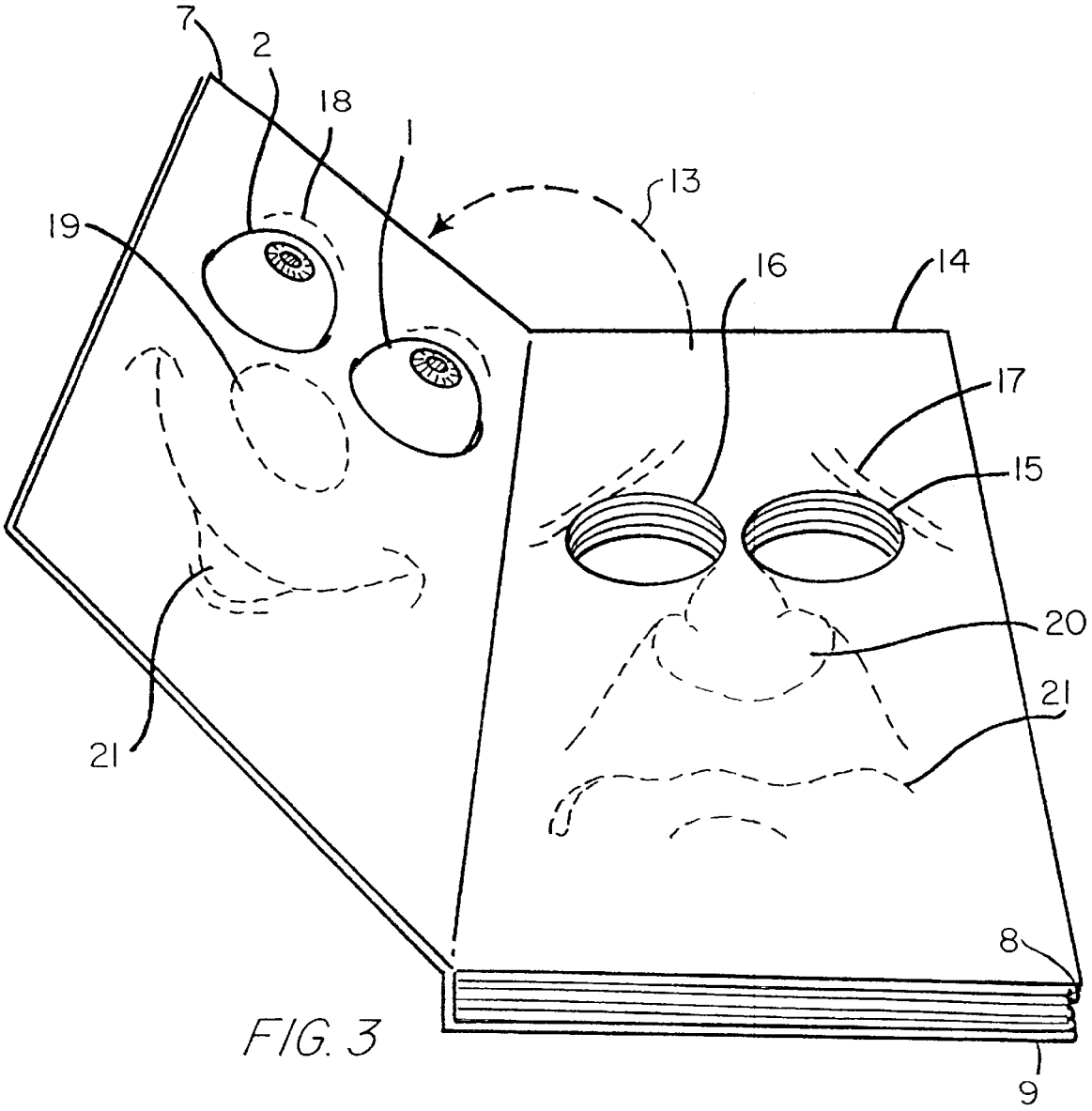
FIG. 3 is a top perspective view of the book or card with the front panel flipped open to reveal the back of the front panel and inner pages or panels of the book, card, or back side of a two-surfaced panel.

Referring next to FIG. 3 the floating eyeballs 1,2 are embedded and affixed to a durable book or card cover or two-surfaced (front and back) panel 7 such that the cover substitutes for the panel 7 described above. The panel or the book or card cover 7 can bear facial features on both its front and back sides. The facial features 16, 17, 18 can be placed around the floating eyeballs 1, 2 (eyeholes 4, 5) to create human, insect, animal or other creature-like facial images.

Figure 4:
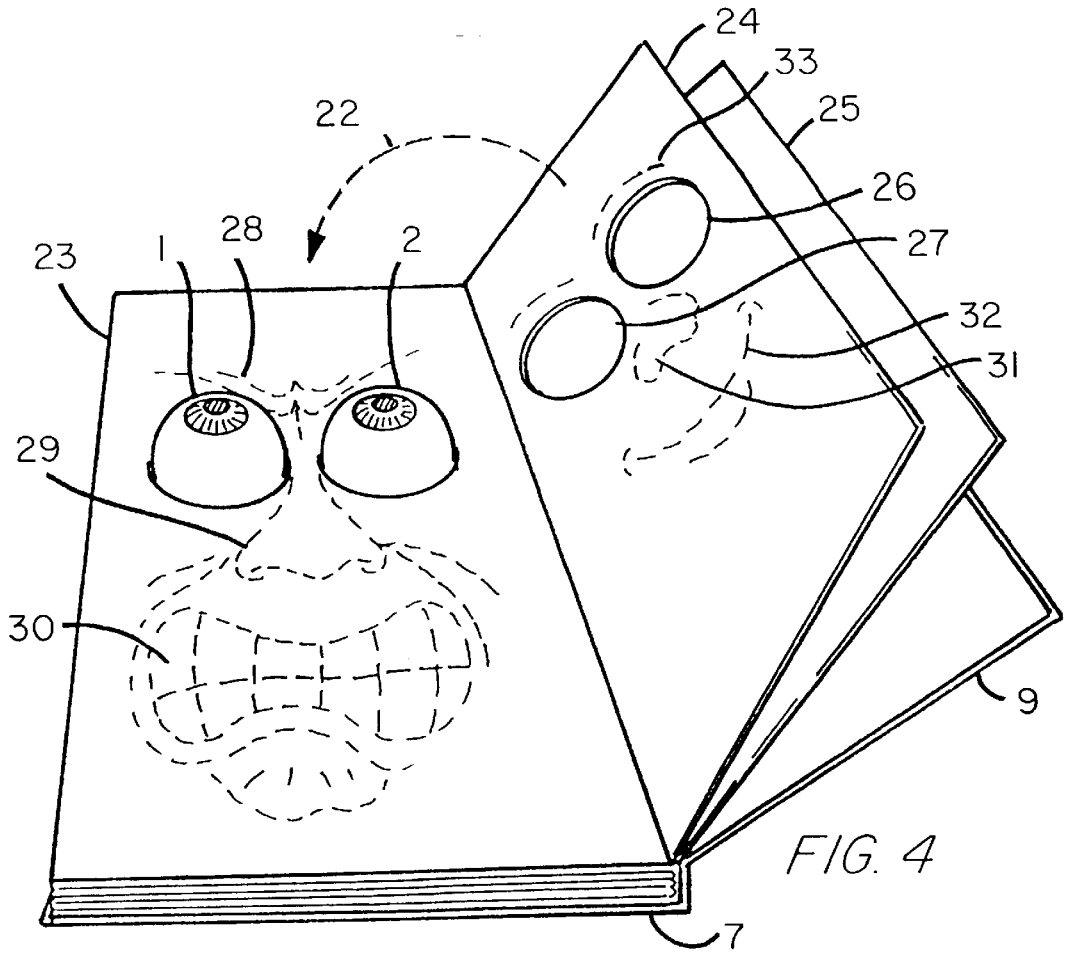
FIG. 4 is a top perspective view of the book with the inner pages or panels being flipped.
Figure 5:
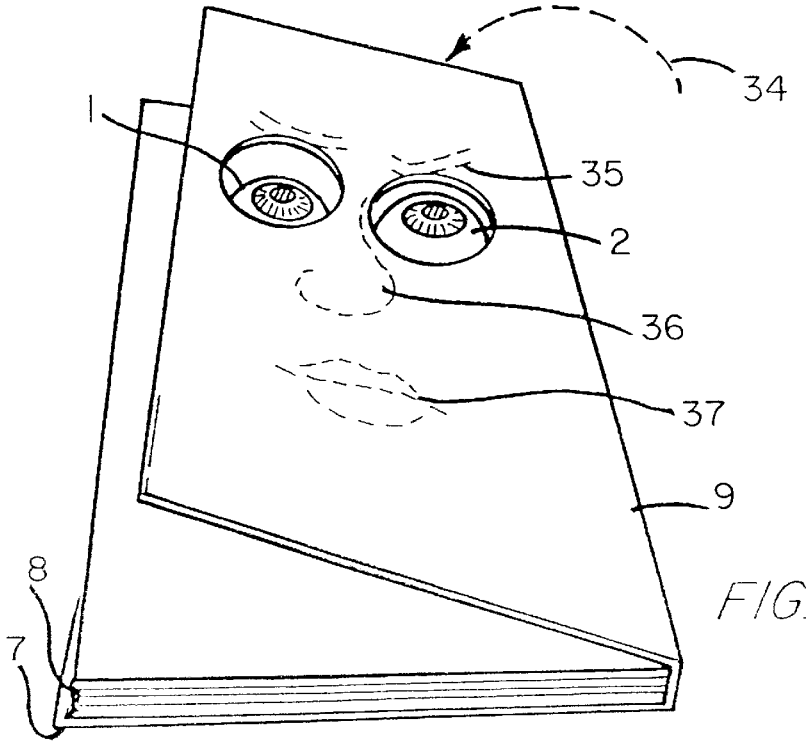
FIG. 5 is a top perspective of the back panel, said panel being a book, card cover, or two-surfaced (front and back) panel.

Additional embodiments shown in FIGS. 4, 5 entail the introduction of numerous additional panels 24, 25 bearing alternative facial features such as 31, 32, 33 over and onto a previous panel 23 containing the affixed floating eyeballs 1, 27. Each additional panel contains a circular eyehole 26, 27 for each floating eyeball 1, 2, permitting the user to quickly and conveniently place the additional panel over and onto the previous panel in order to create a different facial expression or scene. Each additional panel may bear alternative facial features on both its front and back sides.

FIG. 9 is a top profile view of the panel 7 being shaken (represented by 51, 52, 53,) by the user 50 to cause the eyeball-decorated inner spheres 1, 2, to move about (represented by 56, 57) creating an entertaining and amusing visual effect.

Referring to FIGS. 10*a*–10*e*, a series of top panel views is shown. The panel 7 with the affixed floating eyeballs 1, 2 may be tilted in a controlled manner in various directions and angles by the user in order to create the illusion of human-like eye movement. The eyeball-decorated inner sphere rotates about upwards automatically as the panel is tilted in any direction and angle. The panel with the affixed floating eyeballs may also be tilted in a controlled manner into fixed positions by the user in order to create the illusion that floating eyeballs are glancing in one particular direction or as if the floating eyeballs are looking at something on the panel.

Figure 11:
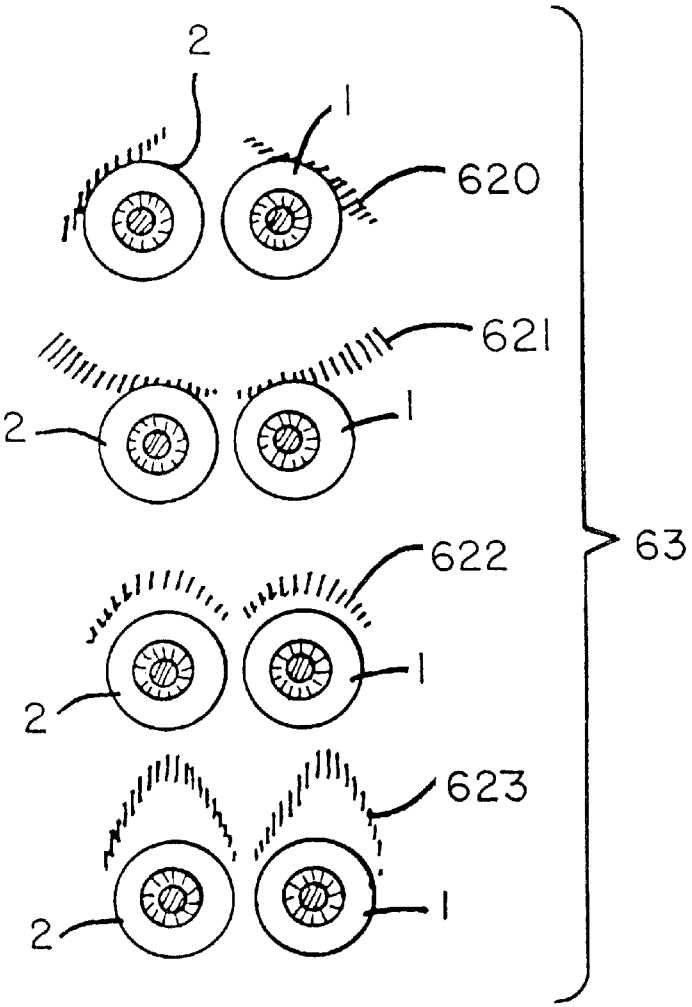
FIG. 11 is a variety of examples of facial expressions the user may choose to draw, paint or otherwise place around the floating eyeballs on blank panels.
Figure 13:
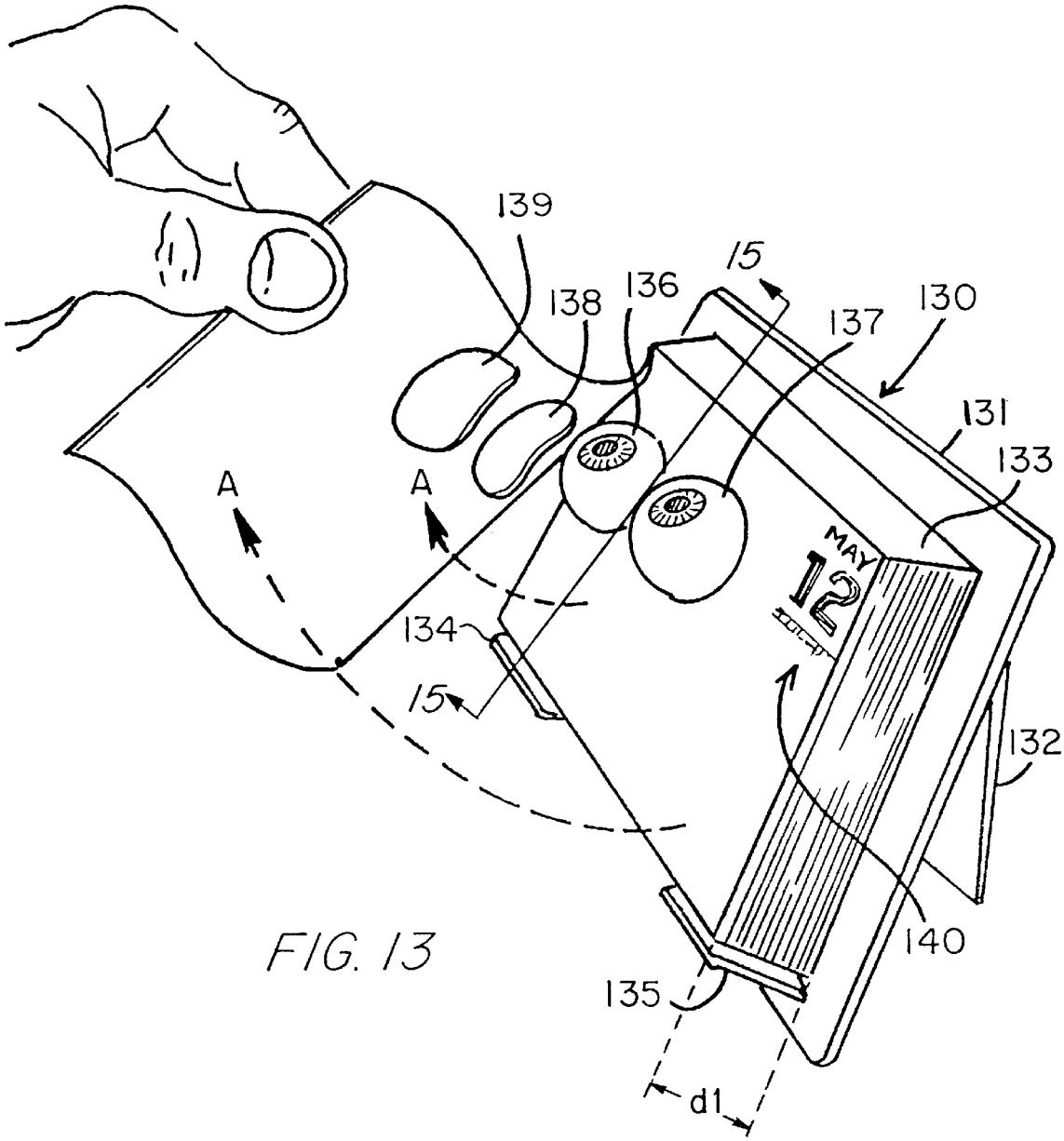
FIG. 13 is a top perspective view of an alternate embodiment, a floating eyeball calendar.
Figure 14:
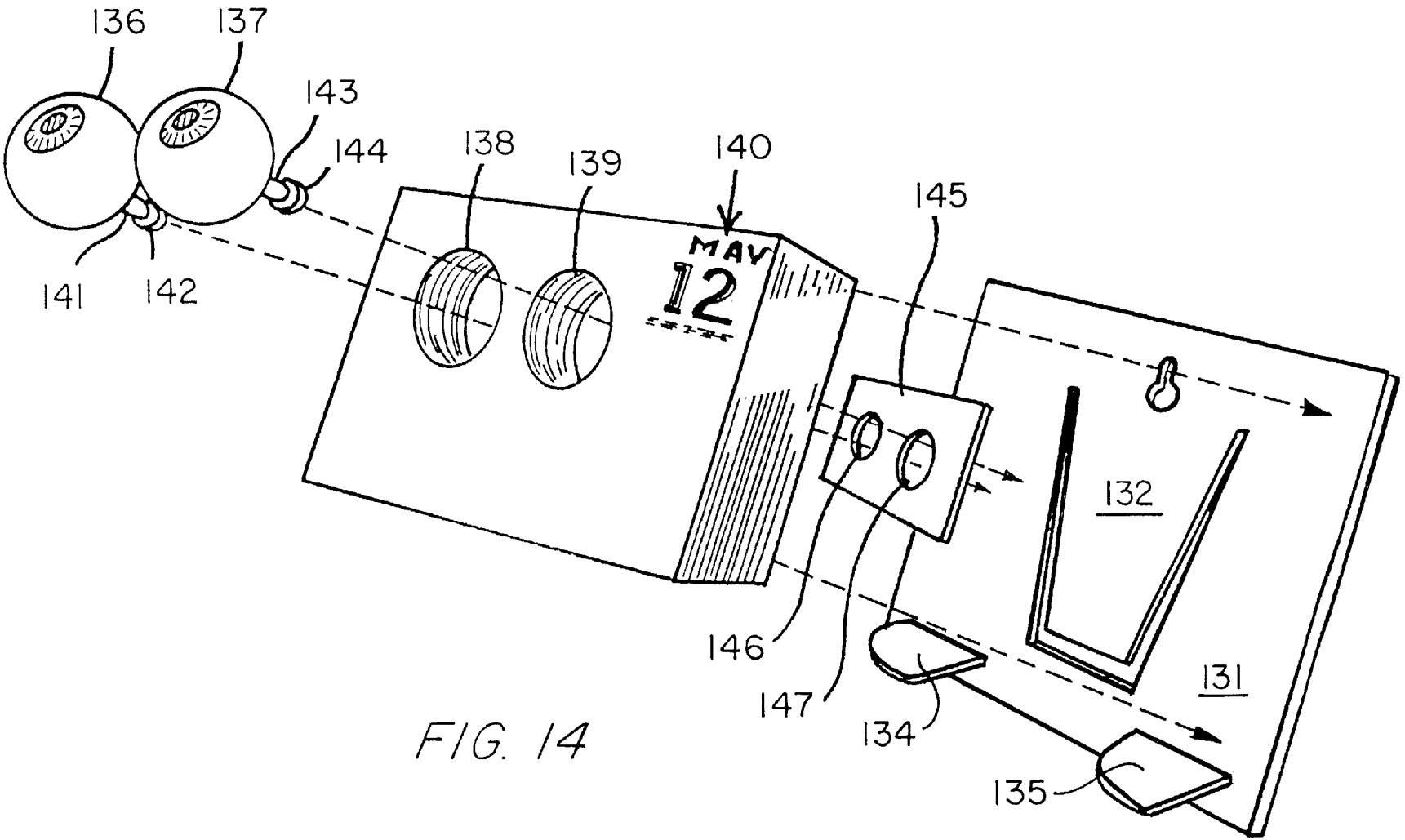
FIG. 14 is an exploded view of the calendar embodiment of FIG. 13.

FIG. 11 shows examples of user added eyebrows 620, 621, 622, 623 to a blank panel 63 by the user.

Figure 12:
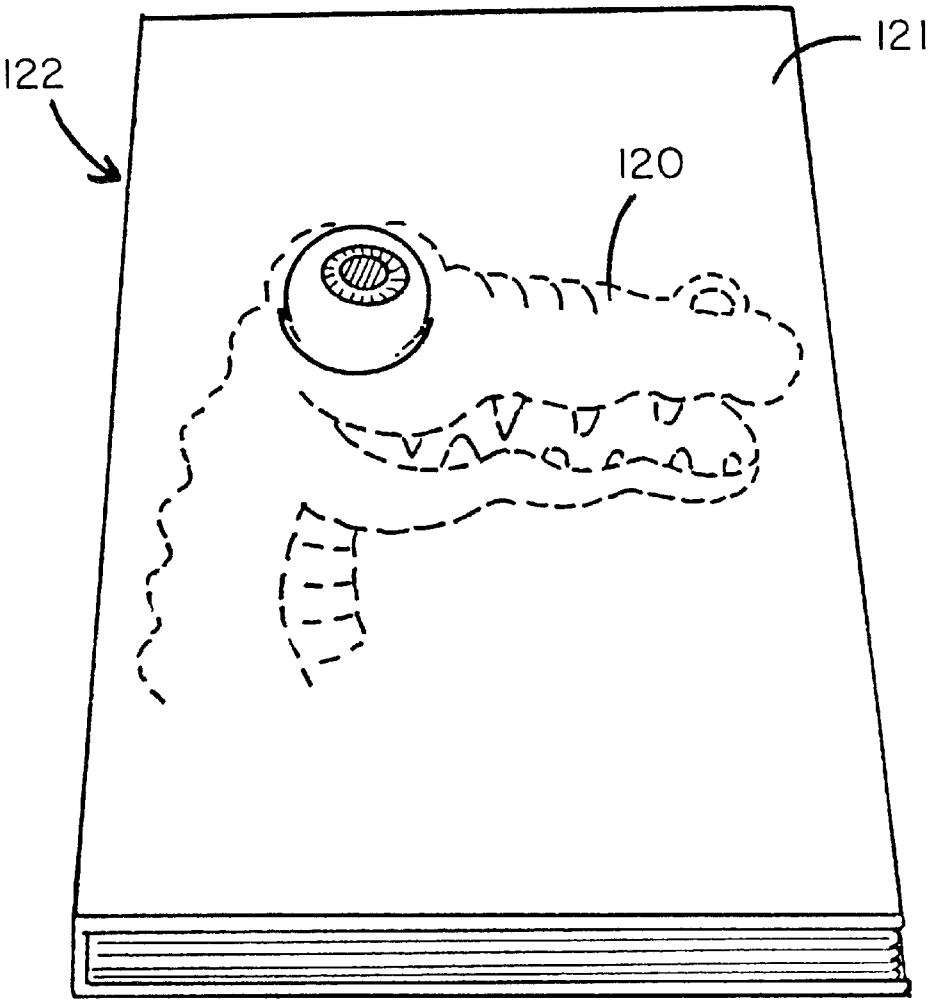
FIG. 12 is a perspective view of a single eyeball embodiment.

FIG. 12 shows a one eyeball embodiment having a crocodile caricature 120 on a book cover 121 for a book 122.

To summarize, the invention may be used to entertain and amuse the user in any of the following manners:

1. The primary panel with the affixed floating eyeballs may be shaken by the user, in order to cause the eyeball-decorated inner sphere to move about creating an entertaining and amusing visual effect. See FIG. 9.
2. The panel with the affixed floating eyeballs may be tilted in a controlled manner in various directions and angles by the user in order to create the illusion of human-like eye movement. The eyeball-decorated inner sphere automatically rotates upwards as the panel is tilted in any direction and angle. See FIGS. 10*a*–10*e*.
3. The panel with the affixed floating eyeballs may be tilted in a controlled manner into fixed positions by the user in order to create the illusion that floating eyeballs are glancing in one particular direction or as if the floating eyeballs are looking at something on the panel. See FIGS. 10*a*–10*e*.
4. The panel with the affixed floating eyeballs may be turned over or reversed by the user to reveal the back side of the panel in order to create the illusion that the floating eyeballs have flipped to the back side of the panel when in reality the panel and not the floating eyeballs have been flipped. See FIG. 3.
5. Additional panels with eyeholes bearing alternative facial features can quickly and conveniently be placed by the user over the existing panel with the affixed floating eyeballs in order to create different facial expressions. See FIG. 4.
6. The user can create its own facial features by drawing or painting on blank panels with eyeholes and then place these panels over the existing panel with the affixed floating eyeballs. See FIG. 11.
7. The panels can be painted or drawn to represent various facial expressions, such as happy or sad faces.
8. A single floating eyeball can be affixed to the panel in order to create a profile facial image as opposed to the frontal facial image created by the affixation of two floating eyeballs to the panel. See FIG. 12.
9. The panels may be marked with written instructions to show the user how to direct the floating eyeballs to look in various directions.

Referring next to FIGS. 13, 14, 15, and 16 a calendar 130 has a backplate 131 and a stand 132. The calendar pages 133 are supported by ledges 134, 135. The floating eyeballs 136, 137 protrude through holes 138, 139 in the pages 133. Each page 133 has alpha-numeric characters 140 to indicate the date. Each day a page 133 is removed as indicated by arrows "A" to provide the proper date to the user.

During use, the distance $d_1$ will decrease. In order to maintain the entertaining sight of eyeballs protruding through the uppermost page, the eyeballs 136, 137 must periodically be adjusted to move back towards the backplate 131. An embodiment not shown would size the eyeballs to protrude all the way through the pad without adjustment. To accomplish this task, a tab 145 having holes 146, 147 is provided which removably engages the fasteners 142, 144 of the floating eyeballs 136, 137. Legs 141, 143 affix the fasteners 142, 144 to the floating eyeballs 136, 137.

Figure 15:
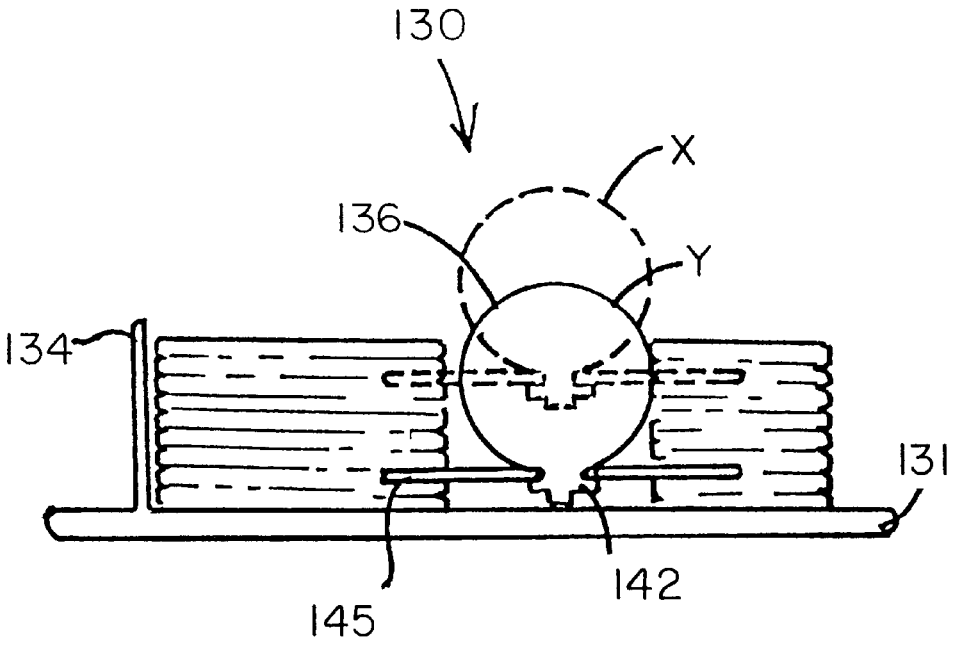
FIG. 15 is a sectional view taken along line 15—15 of FIG. 13 showing the positioning of the support tab for the floating eyeballs.
Figure 16:
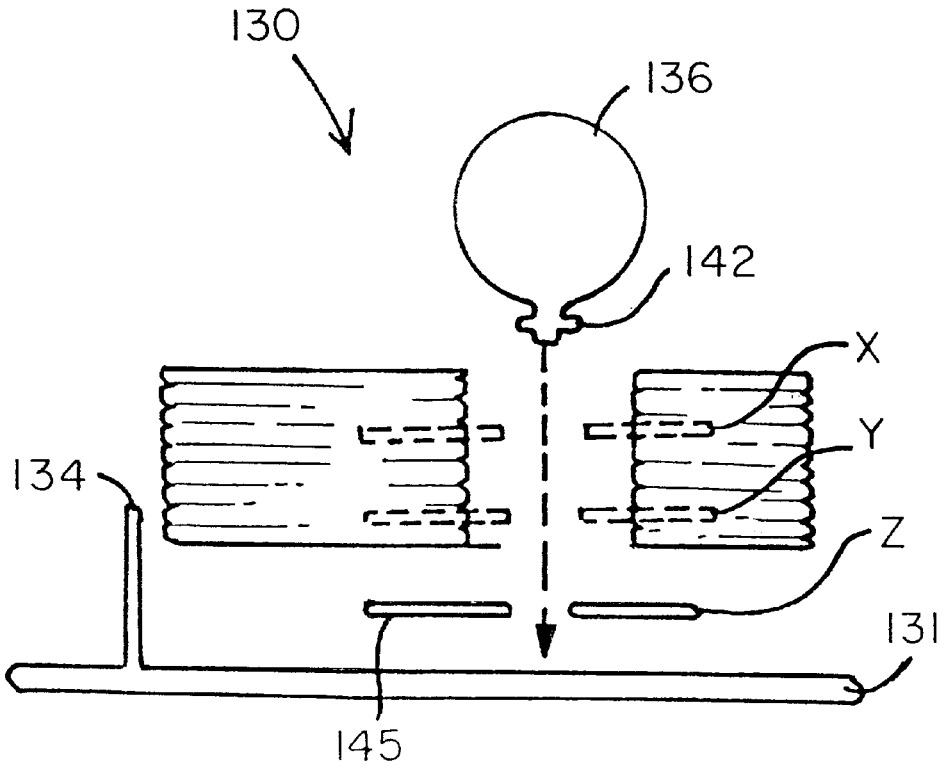
FIG. 16 is the same view as FIG. 15 showing the steps of adjusting the height of the floating eyeballs.

Referring next to FIGS. 15, 16 the user may place the tab 145 at position "Z" . He must first lift up the pages 133 as shown in FIG. 16. The tab 145 has floating eyeballs 136, 137 attached to it. Once the tab 145 is in the desired position, "X", "Y", or "Z" , the pages 133 are placed over the floating eyeballs. In the preferred embodiment of the calendar 130 as shown, the fasteners 142, 144 allow the user to pull out the floating eyeballs 136, 137, move the tab 145, and re-insert the floating eyeballs down through holes 138, 139 into the tab 145.

Figure 17:
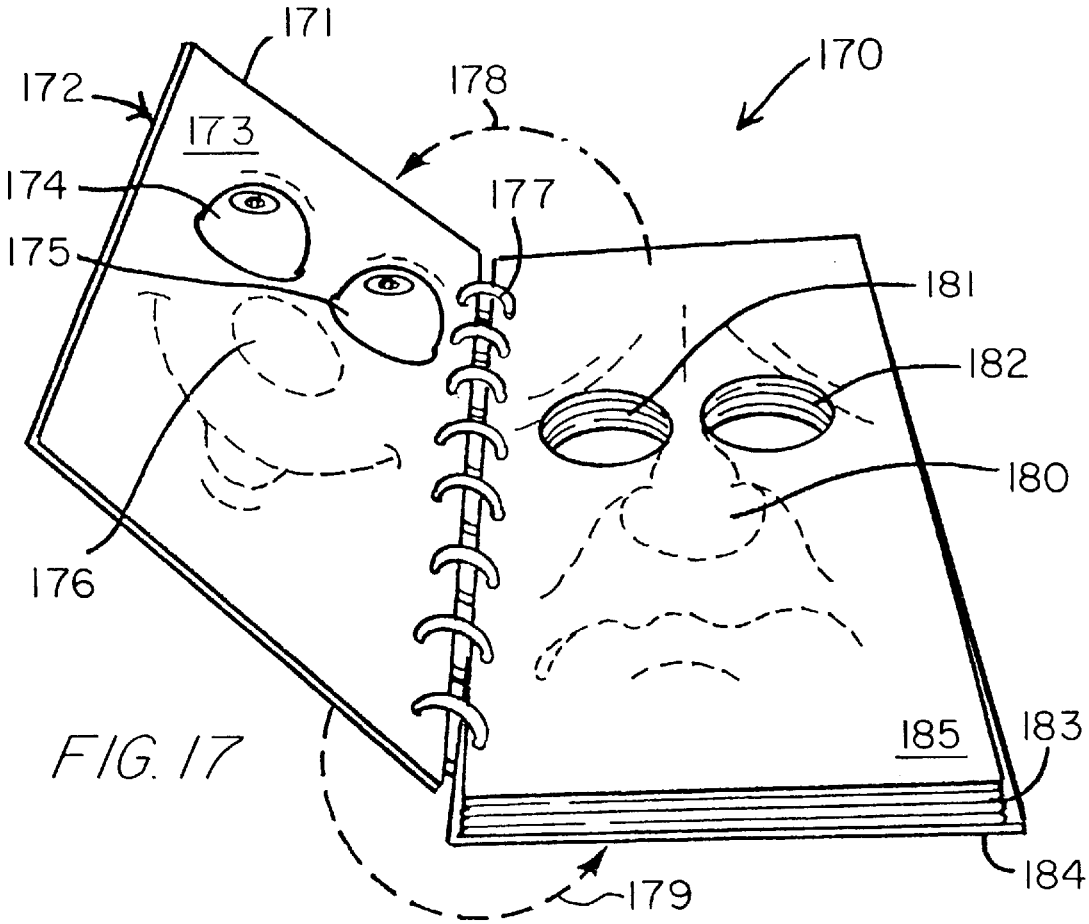
FIG. 17 is a top perspective view of a book embodiment having a spiral binder.
Figure 18:
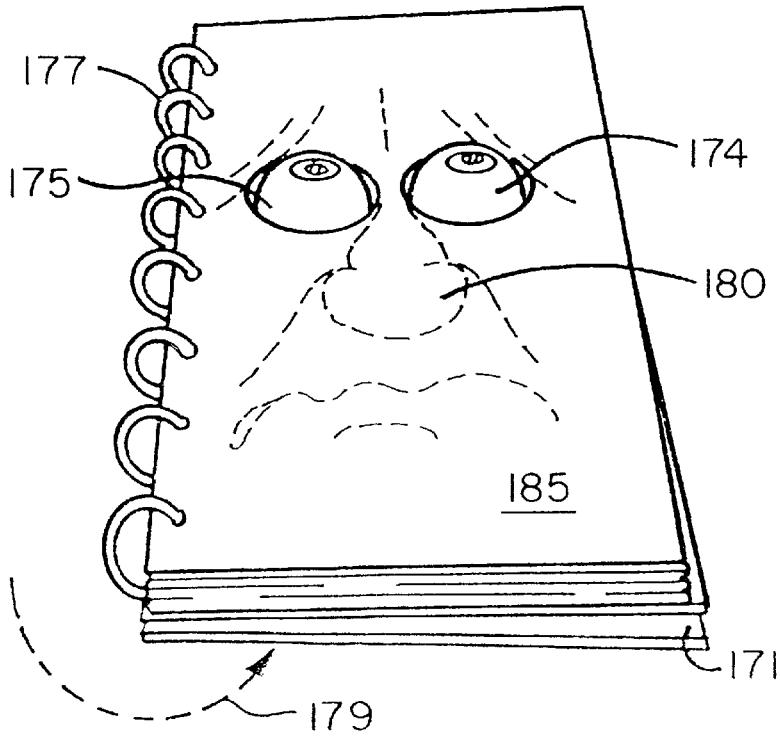
FIG. 18 is the same view as FIG. 17 with the book closed.

Referring next to FIG. 17 a horizontal format book 170 has a spiral binder 177. The front panel 171 has a pair of floating eyeballs 174, 175. The front panel 171 also has a front page 172 preferably having a coordinated design with the floating eyeballs 174, 175, and an inside cover page 173 having the smiley face design 176. The inside pages 183 include second page 185 having the grown design 180. There is also a back panel 184. The inner pages 183 and back panel 184 all have holes 181, 182 which allow the floating eyeballs 174, 175 to pass through with the front panel 171 opened in direction 178. The smiley face design 176 coordinates with the floating eyeballs 174, 175 as shown in FIG. 18. All the inside pages 183 can have a coordinated design on both sides in this embodiment.

Figure 19:
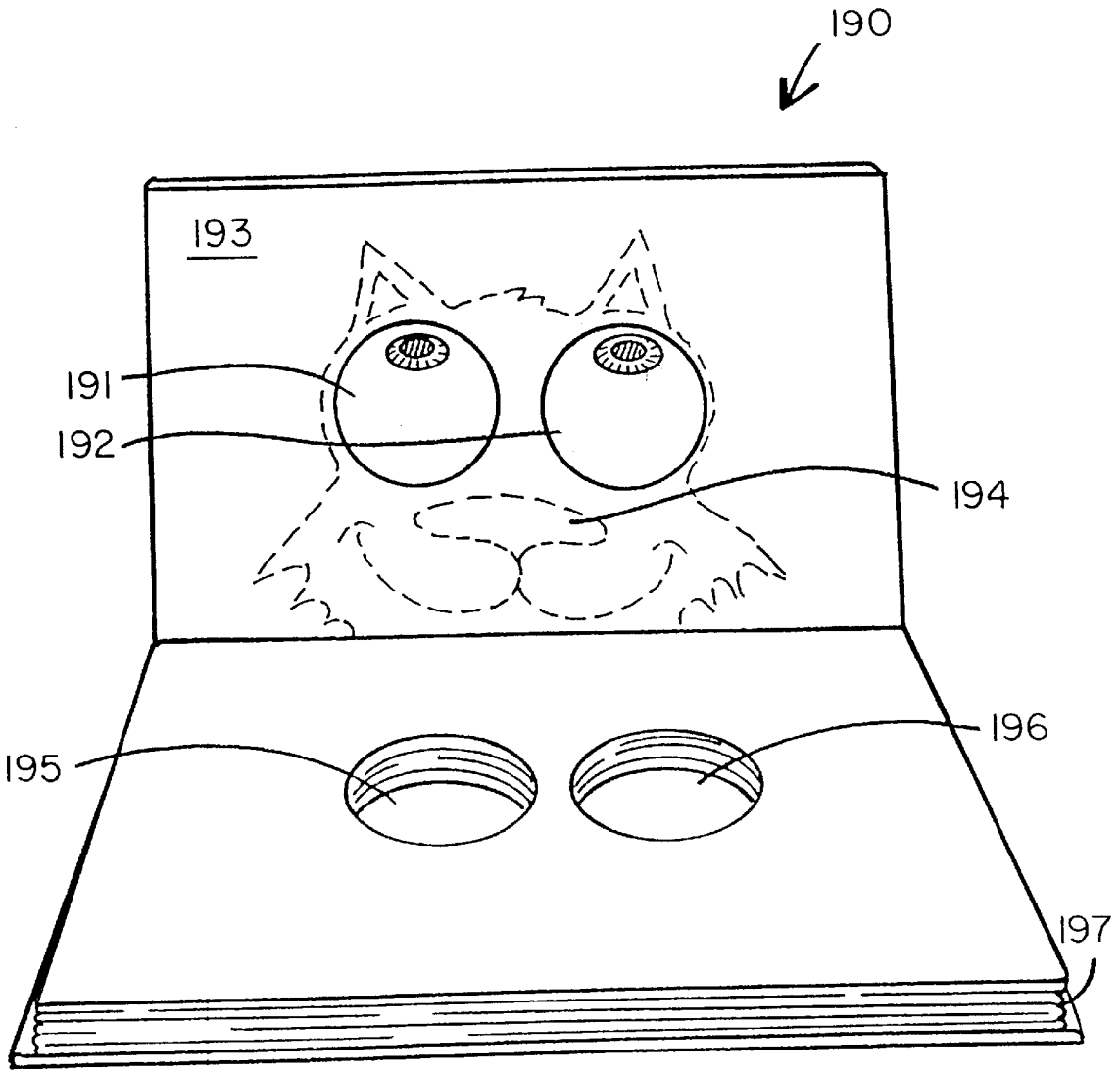
FIG. 19 is a top perspective view of a book embodiment with a vertical format.

Referring next to FIG. 19 a vertical format book 190 is shown. A top panel 193 houses the floating eyeballs 191, 192. The coordinated design 194 is located on the inside cover page. Preferably, another design is on the front cover page (not shown). The inside pages 197 have holes 195, 196. Each inside page, preferably, has a coordinated design on each underside for display with the floating eyeballs 191, 192 as desired.

Yet another alternate embodiment not shown includes a doodle pad identical to the calendar 130 but with the deletion of the alpha-numeric characters 140 and/or the addition of illustrations.

Although the present invention has been described with reference to preferred embodiments, numerous modifications and variations can be made and still the result will come within the scope of the invention. No limitation with respect to the specific embodiments disclosed herein is intended or should be inferred.

KEY

1. Left eyeball
2. Right eyeball
3. Motion of embedding left eyeball into panel
4. Motion of embedding right eyeball into panel
5. Left eyehole
6. Right eyehole
7. Panel or book cover
8. Inner pages or panels of a book or card
9. Back cover of book or card
10. Painted or drawn on facial features
11. Painted or drawn on facial features
12. Painted on or drawn facial features
13. Arrow representing the opening or flipping of a front panel or cover of book or card
14. Additional page or panel
15. Left eyehole in additional panel
16. Right eyehole in additional panel
17. Painted or drawn on facial features
18. Painted or drawn on facial features
19. Painted or drawn on facial features
20. Painted or drawn on facial features
21. Painted or drawn on facial features
22. Arrow representing the turning or flipping of inner pages or panels onto an inner previous page or panel
23. Previous inner page or panel
24. Inner Page or panel with eyeholes
25. Inner Page or panel with eyeholes
26. Left eyehole
27. Right eyehole
28. Painted or drawn on facial features
29. Painted or drawn on facial features
30. Painted or drawn on facial features
31. Painted or drawn on facial features
32. Painted or drawn on facial features
33. Painted or drawn on facial features
34. Arrow representing the turning or flipping of the back panel or cover of book or card onto an inner previous page or panel
35. Painted or drawn on facial features
36. Painted or drawn on facial features
37. Painted or drawn on facial features
38. Arrow representing the tilting of the panel in different directions and the automatic upwards rotation of the eyeball affixed to the panel
39. Arrow representing the automatic upwards rotation of the eyeball during slight tilting of the panel above horizontal
40. Arrow representing the automatic upwards rotation of the eyeball during tilting of the panel at an approximately 45 degree angle
41. User's hand holding panel slightly tilted above horizontal
42. User's hand holding panel tilted at approximately 45 degrees
43. Clear plastic outer sphere of right eyeball
44. Right eyeball-decorated inner sphere
45. Clear liquid separating right eyeball-decorated inner sphere and clear outer shell
46. Adhesive or other glue locking system
47. Clear plastic outer sphere of left eyeball
48. Left eyeball-decorated inner sphere
49. Clear liquid separating left eyeball-decorated inner sphere and clear outer shell
50. User's hand holding and shaking panel
51. Dotted lines representing motion of shaking panel
52. Dotted lines representing motion of shaking panel
53. Dotted lines representing motion of shaking panel
54. Dotted lines representing motion of shaking hand
55. Lines representing visual effect of human-like eye movement
56. Lines representing visual effect of human-like eye movement
57. Painted or drawn on facial features
58. Painted or drawn on facial features
59. Painted or drawn on facial features

60. Series of left eyeballs showing pupils rotating
61. Series of right eyeballs showing pupils rotating
62. User drawn eyebrows on blank panel
63. Blank panel
120. Caricature
121. Book Cover
122. Book
130. Calendar
131. Backplate
132. Stand
133. Calendar pages
134, 135. Ledges
136, 137. Floating eyeballs
138, 139. Holes
140. Alpha-numeric characters
141, 143. Legs
142, 144. Fasteners
145. Tab
146, 147. Holes
170. Horizontal format book
171. Front panel
172. Front page
173. Cover page
174, 175. Floating eyeballs
176. Smiley face design
177. Spiral binder
178. Direction
179. Direction
180. Frown design
181, 182. Holes
183. Inside pages
184. Back panel
185. Second page
190. Vertical format book
191, 192. Floating eyeballs
193. Top panel
194. Coordinated design
195, 196. Holes
197. Inside pages
"X", "Y", "Z". Positions

I claim:

1. A three-dimensional book comprising:

a first panel having a hole which supports a spherical ball to bulge outward from both a front and a back side of the first panel;

a plurality of inner pages, each page having a hole aligned with the hole of the first panel and each page having a first viewing side containing a graphic depiction; and said inner pages bound to an edge of the first panel to allow a user to turn the pages to an open page which rests against the first panel to expose a viewing side of the page having the spherical ball bulging therethrough.

2. The book of claim 1, wherein the front and back sides of the first panel each have a graphic depiction.

3. The book of claim 2, wherein the graphic depictions of the first panel each contains a facial expression coordinated with the bulging spherical toy ball.

4. The book of claim 1, wherein the graphic depictions of each inner page each contains a facial expression coordinated with the bulging spherical toy ball.

5. The book of claim 4 further comprising a second panel bound with the inner pages and having a hole aligned with the hole of the first panel and having a second panel viewing surface with the spherical toy ball bulging therethrough, said second panel viewing surface containing a graphic depiction including a facial expression coordinated with the spherical toy ball.

6. A three-dimensional book comprising:

a front cover, a rear cover, and a plurality of inner pages, all having an aligned hole;

said front cover having a spherical toy ball mounted in its hole bulging above the front cover and bulging out the rear cover through the aligned hole; and said inner pages each having a viewing surface containing a graphic depiction coordinated with the spherical toy ball, whereby turning the inner pages against the front cover creates an entertaining expression which can be made more entertaining by shaking and tilting the book to create a visual impression of a dancing object in a variety of expressions.

7. A three-dimensional book comprising:

a front cover, a rear cover, and a plurality of inner pages, all having an aligned hole;

said rear cover having a spherical toy ball mounted in its hole bulging above the front cover and bulging out the rear cover through the aligned hole; and said inner pages each having a viewing surface containing a graphic depiction with an expression coordinated with the spherical toy ball, whereby turning the inner pages against the front cover creates an entertaining expression which can be made more entertaining by shaking and tilting the book to create a visual impression of a dancing object in a variety of expressions.

* * * * *